United States Patent [19]

Bakermans et al.

[11] Patent Number: 4,809,576

[45] Date of Patent: Mar. 7, 1989

[54] SCRAP REMOVAL SYSTEM FOR STAMPING AND FORMING MACHINE AND SENSOR APPARATUS FOR DETECTING MOVEMENT BETWEEN CONVEYOR BELTS

[75] Inventors: Johannes C. W. Bakermans, Harrisburg; Dimitry G. Grabbe, Middletown, both of Pa.

[73] Assignee: AMP Incorporated, Harrisburg, Pa.

[21] Appl. No.: 89,191

[22] Filed: Aug. 25, 1987

[51] Int. Cl.[4] ..... B26D 7/06; B65G 43/00; G01B 7/16

[52] U.S. Cl. ..... 83/155; 83/155.1; 83/109; 83/167; 198/502.1; 198/502.4; 198/856; 73/467; 73/768

[58] Field of Search ..... 83/50, 54, 55, 40, 155, 83/155.1, 109, 167; 198/502.1, 502.4, 571, 573, 575, 617, 464.4, 856; 73/466, 467, 768, 157, 705, 711

[56] References Cited

U.S. PATENT DOCUMENTS

| | | | |
|---|---|---|---|
| 3,440,909 | 4/1969 | Schmid et al. | 83/61 |
| 3,524,370 | 8/1970 | Thompson | 83/620 X |
| 3,589,221 | 6/1971 | Deegan | 83/620 X |
| 3,789,711 | 2/1974 | Mead | 83/61 |
| 3,874,262 | 4/1975 | Cailloux | 83/687 X |
| 4,012,027 | 3/1977 | Hooper | 83/50 X |
| 4,235,089 | 11/1980 | Vecchi | 83/620 X |
| 4,267,753 | 5/1981 | Bennett | 83/690 X |
| 4,462,523 | 7/1984 | Kerr | 198/856 |
| 4,475,424 | 10/1984 | Kouno et al. | 83/549 |
| 4,497,196 | 2/1983 | Bakermans | 72/405 |
| 4,501,179 | 2/1985 | Iwata | 83/620 X |
| 4,516,450 | 5/1985 | Shuttleworth | 83/146 |
| 4,708,042 | 11/1987 | Jung | 83/112 |

FOREIGN PATENT DOCUMENTS

| | | | |
|---|---|---|---|
| 2622475 | 12/1977 | Fed. Rep. of Germany | 198/502.1 X |
| 2294954 | 7/1976 | France | 198/856 X |
| 60-171909 | 9/1985 | Japan | 198/502.1 X |

*Primary Examiner*—William L. Sikes
*Assistant Examiner*—Brian M. Healy
*Attorney, Agent, or Firm*—Bruce J. Wolstoncroft; Frederick W. Raring

[57] ABSTRACT

A scrap removal system is disclosed for a stamping and forming machine in which strip material is fed in a vertical plane through a tooling assembly having punches and dies therein so that holes are punched in the strip when the punches move through the strip and into the die openings. Such punching operations produce small bits of scrap material commonly referred to as slugs. The die block is mounted against a supporting structure which has passageways extending therethrough in alignment with the die openings so that as the slugs are produced, they are pushed into the passageways and form stacks of aligned slugs. The passageways extend to outlets, past which a slug removing device in the form of an endless belt continuously moves. As the slugs are pushed from the slug outlets, the endless belt carries them laterally and disposes of them at a location beside the tooling assembly. A detecting means is also disclosed which stops the machine in the event of failure of the scrap removal system.

20 Claims, 10 Drawing Sheets

SCRAP REMOVAL SYSTEM FOR STAMPING AND FORMING MACHINE AND SENSOR APPARATUS FOR DETECTING MOVEMENT BETWEEN CONVEYOR BELTS

FIELD OF THE INVENTION

This invention relates to stamping and forming machines of the type in which the strip material is fed in a vertical plane through a machine modules in which the stamping and forming operations are carried out on the strip. The invention particularly concerns the removal of the scrap material or slugs which are produced when holes are punched by punches and dies in the strip material.

RELATED U.S. PATENTS AND PENDING PATENT APPLICATIONS

The embodiment of the invention disclosed herein is particularly intended for use in a stamping and forming machine of the type described fully in U.S. Pat. No. 4,497,196 which is hereby incorporated by reference in its entirety. The disclosed embodiment also incorporates an improved strip feed mechanism of the type described in application Ser. No. 57,556 filed June 3, 1987, pending, and other features described in application Ser. No. 74,656 filed July 17, 1987, pending.

BACKGROUND OF THE INVENTION

U.S. Pat. No. 4,497,196 describes in detail a stamping and forming machine of a type in which the strip material is fed from an endless source in a vertical plane through a plurality of individual modules, each of which contains stamping and forming tooling. In virtually all stamping and forming operations, punches and dies are used to punch out from the strip some of the material so that the finished products remain at the end of the forming operation. The punching operations result in the production of large numbers of small bits of scrap metal, commonly referred to as slugs, which must be continually removed from the vicinity of the punch and die so that they will not interfere with the operation of the machine. In a conventional stamping and forming press, in which the strip material is in a horizontal plane, these slugs are pushed from the strip and fall downwardly by gravity through an opening in the die plate and in the supporting structure under the die plate. When the strip material is in a vertical plane, however, the slugs cannot fall under the influence of gravity away from the strip and they must be removed by other means. The present invention is directed to the achievement of a slug removing system for such machines. The invention is further directed to the achievement of a sensing means for sensing the relative movement between two parts of a machine which ordinarily move in unison. The latter aspect of the invention is of importance in the embodiment described below for the reason that in the event of failure of the scrap removal system, the machine must be stopped immediately in order to prevent damage thereto by the accumulated slugs which would remain in the stamping area after failure of the slug removing system.

THE INVENTION

The invention comprises a machine for performing punching operations on strip material which is fed in a vertical plane along a strip feed path. The machine has a punching zone through which the strip feed path extends and has first and second tooling assemblies in the punching zone. The tooling assemblies are opposed to each other and are on opposite sides of the strip feed path and are movable relatively towards and away from each other along a tooling path which extends normally of the strip feed path. The tooling assemblies are movable between an open position and a closed position, the tooling assemblies being remote form the strip feed path in the open position and being substantially against each other and against the strip material when in the closed position. The first tooling assembly has at least one punch therein and the second tooling assembly has a die having a die opening in alignment with the punch so that during movement from the open position to the closed position, the punch punches a hole in the strip material and the resulting scrap slug is pushed by the punch into the die opening. The machine is characterized in that the second tooling assembly has a slug receiving passageway extending therethrough parallel to the tooling path, the slug receiving passageway being in alignment with, and extending from, the die opening to a slug outlet. The slug receiving passageway has a profile which conforms to the profile of the die opening and to the profile of the slugs produced by the punch and die. Slug removing and transporting means are provided at the slug outlet, the slug removing and transporting means being movable along a slug transporting path which extends transversely of the tooling path and past the slug outlet to a location beyond the second tooling assembly. During continuous operation of the machine, the slugs produced by the punch and die are pushed through the die opening and into the slug receiving passageway and form a stack of aligned slugs in the passageway. The slugs which are pushed from the passageway at the slug outlet are removed and transported laterally to a location beyond the second tooling assembly for disposal.

In accordance with further embodiments, the slug removing and transporting means comprises an endless flexible belt which is positioned in a belt passageway that extends through the second tooling assembly, the slug outlet communicating with the belt passageway so that the slugs are pushed into the belt passageway. The belt passageway has a width, as measured parallel to the tooling path and normally of the slug transporting path (the path along which the slugs are moved by the belt) which is sufficient to accommodate the belt and permit movement of the second tooling assembly between its open and closed position. The second tooling assembly is adjacent to the slug removing course of the endless belt when the second tooling assembly is in its open position and it is therefore desirable that the belt be flexible.

In accordance with further embodiments, two or more belts may be provided in order to provide for the removal of slugs from two or more punches where the punches are offset from each other with respect to the central axis of the strip material.

In accordance with further embodiments, a sensing means is provided for sensing relative movement of a first element, such as an element of a machine with respect to a second element. The two elements are normally in fixed predetermined positions with respect to each other and are movable in unison without change in their fixed positions with respect to each other. The two elements may be, for example, the two sprockets for the two belts described above. The sensing means in accordance with the invention comprises an indicator and a detector, the indicator comprising an elongated flexible member having a first portion, a second portion, and a detected portion. The first and second portions are in the first and second elements respectively and the detected portion is normally located externally of the first and second elements. The detector is flexible and is movable in the direction of its length with respect to the first and second elements. The detector comprises detection means which is in observing relationship to the detected portion of the indicator and the detector is effective to detect movement of the detected portion of the indicator in the direction of its length so that in the event of relative movement of the first element with respect to the second element during movement of the first and second elements in unison, the detector will detect the resulting movement of the detected portion of the indicator and thereby detect the relative movement of the first element with respect to the second element.

In accordance with one embodiment, the first and second elements of the machine have aligned openings extending therethrough normally of the direction of movement of the elements and the first and second portions of the detector are in the aligned openings. The elements of the machine may be rotating elements or elements that move along rectilinear paths.

THE DRAWING FIGURES

THE DISCLOSED EMBODIMENT

Figure 8:
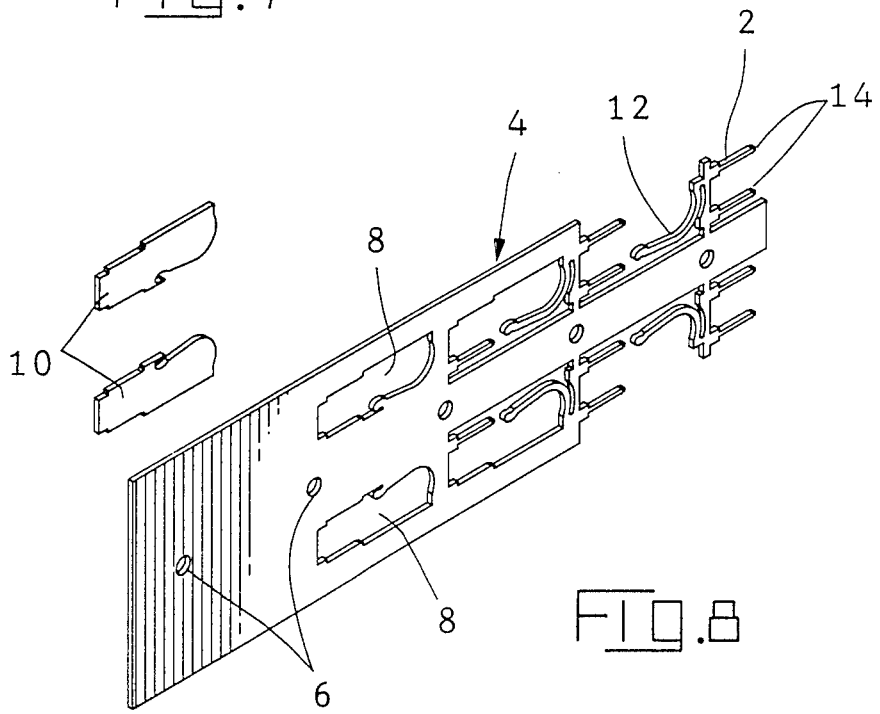
FIG. 8 is a perspective view of a short section of strip material illustrating the manner in which scrap slugs are produced during the production of electrical terminals in strip form.
Figure 9:
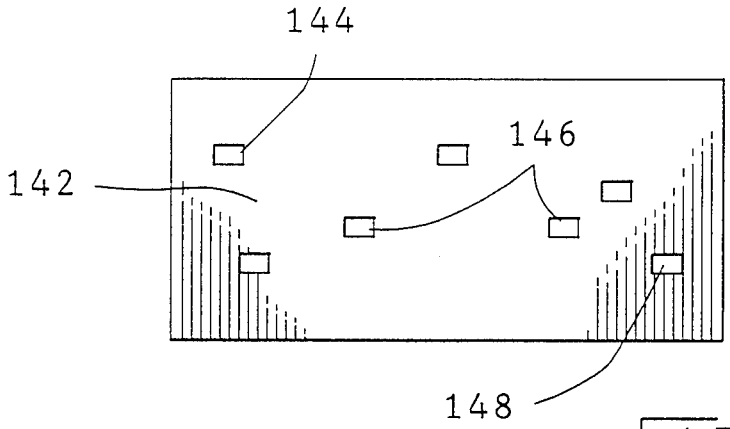
FIG. 9 is a plan view of a die plate having a plurality of die openings therein which are not coplanar.
Figure 10:
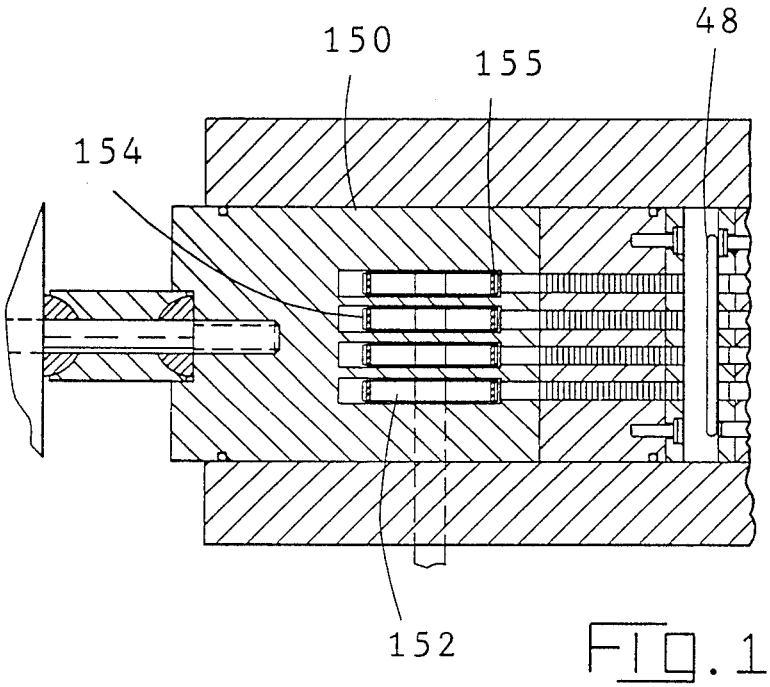
FIG. 10 is a semidiagrammatic view showing a tooling assembly having a plurality of scrap removing systems for the several die openings of the die plate of FIG. 9.

FIG. 8 illustrates the manner in which terminals 2 are produced from strip metal 4 by a series of punching operations. Each of the terminals has a contact arm 12 and a pair of spaced-apart posts 14 by means of which it is mounted in a circuit board. The terminals are produced by a series of punching operations in which portions of the strip 4 are removed. Initially, pilot holes 6 are punched in the strip to permit it to be fed past the punches and dies. Thereafter, the punches remove the material to produce holes as shown at 8 and bits of scrap or slugs 10. Subsequent to punching of holes 8, more slugs are produced as additional material is removed.

The present invention relates to a scrap or slug handling or removing system for a machine of the type shown in U.S. Pat. No. 4,497,196. Only those portions of the machine which are required for an understanding of the instant invention are described below.

Figure 2:
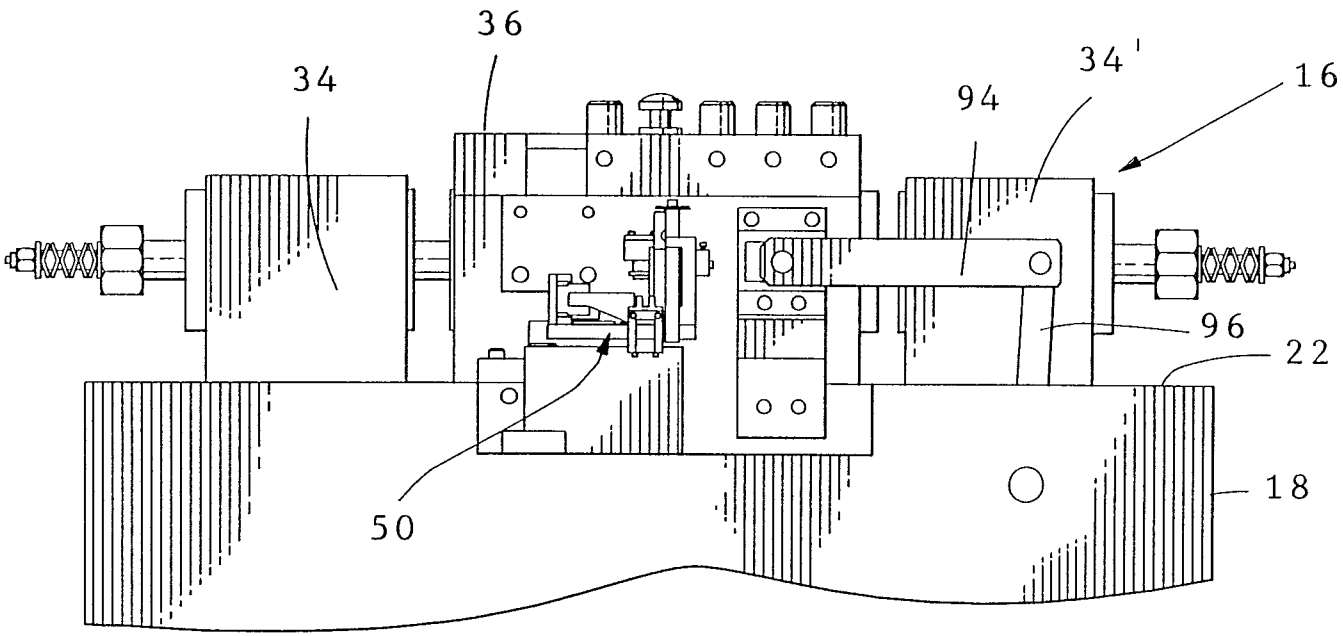
FIG. 2 is an end view looking in the direction of the arrows 2—2 of FIG. 1.
Figure 3:
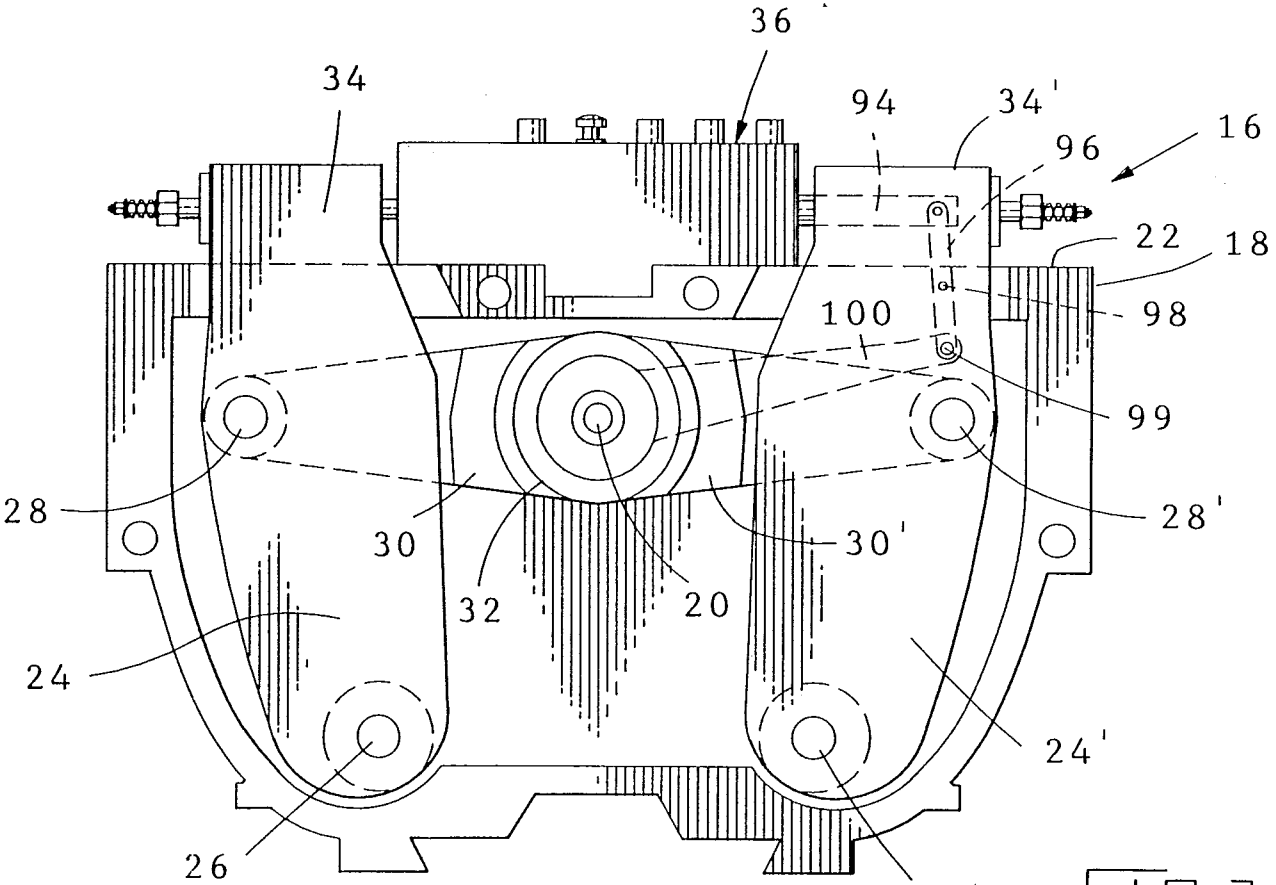
FIG. 3 is a sectional view looking in the direction of the arrows 3—3 of FIG. 1.

The machine shown in U.S. Pat. No. 4,497,196 comprises a plurality of machine modules 16 (FIGS. 1–3), each of which has a module housing 18 having an upper surface 22 and a centrally located continuously rotating shaft 20 therein. Levers 24, 24' are located on each side of the shaft 20 and are pivoted at their lower ends 26, 26'. Intermediate their ends, the levers are pivoted at 28, 28' to links 30, 30'. The links extend to the shaft 20 and are connected to the shaft by eccentrics indicated at 32 so that during continuous rotation of the shaft, the levers are oscillated in synchronism with each other so that their upper ends 34, 34' move towards and away from each other.

A tooling assembly housing 36 is supported centrally on the upper surface 22 of the module and between the upper ends of the levers. The housing 36 has a rectangular opening extending therethrough which contains first and second tooling assemblies 38, 40 (FIGS. 4–7), which are opposed to each other and which may move towards and away from each other during each operating cycle of the machine. The tooling assemblies are connected to the upper ends of the levers by spacers or thrust members 42, 42'.

The strip material 4 is fed by a strip feed mechanism 50, which is described in application Ser. No. 57,556, along a strip feed path which extends through an upstream strip guide 44, through the housing 36, and through a downstream strip guide 46. Slots 48 are provided in the sides of the housing 36 through which the strip passes. The strip feeding mechanism 50 comprises an intermittently rotated strip feeding wheel 52 and an additional strip guide 54 which is pivoted at its end which is adjacent to the downstream strip guide 46. The additional strip guide 54 is swung outwardly during nonfeeding intervals so it is not against the strip and is swung inwardly towards the strip and against the strip in feeding intervals. This movement of the strip guide 54 is accomplished by a bell crank mechanism 56 having one arm 58 which extends to, and is eccentrically coupled to, a continuously rotating shaft 60. Shaft 60 is also utilized to operate the scrap removal system as will be described below.

Figure 4:
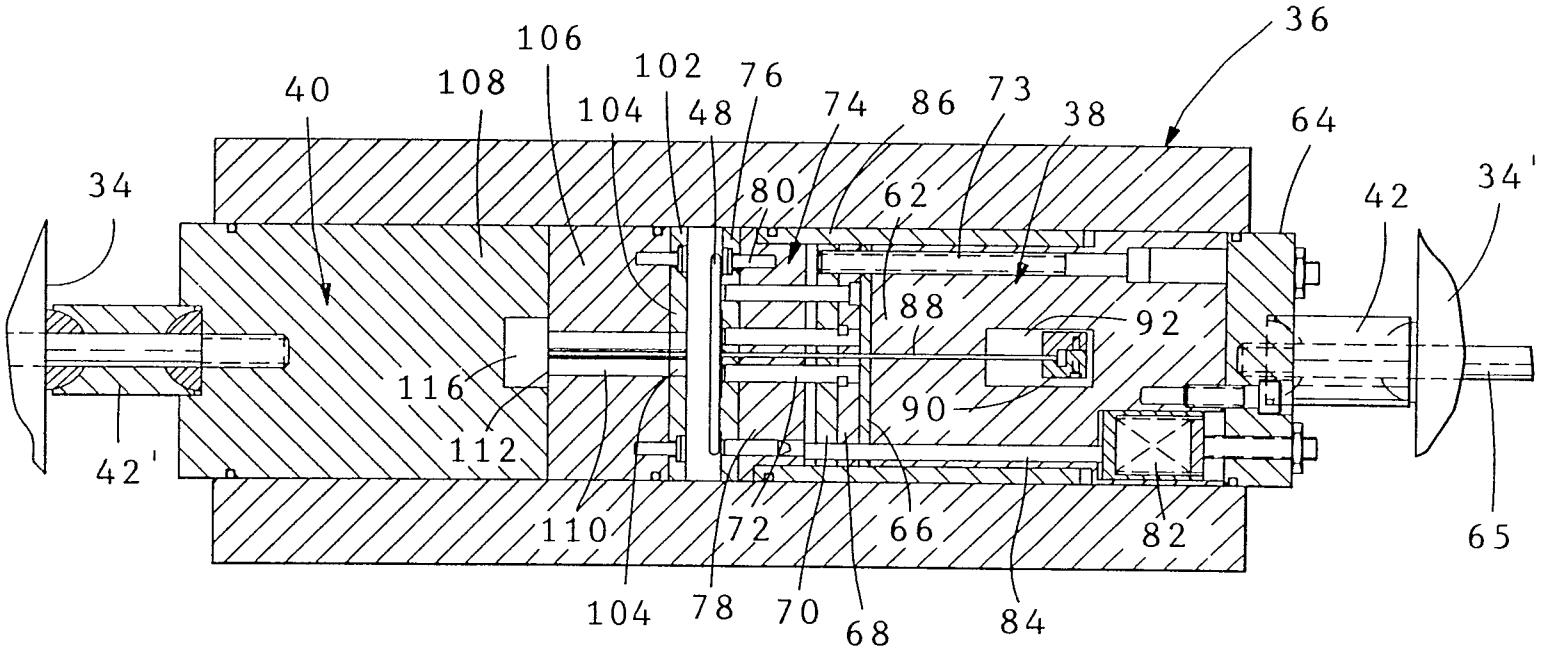
FIG. 4 is a sectional view of the tooling module looking in the direction of the arrows 4—4 of FIG. 1

The first tooling assembly 38 (FIG. 4) comprises a ram block 62 having a back plate 64 secured to its right-hand end as viewed in FIG. 4 against which the thrust member 42 bears. The tooling assembly is pushed leftwardly from its position shown in FIG. 4 and is retracted by a cable mechanism indicated at 65 and described in application Ser. No. 74,656 filed July 17, 1987. A thin spacer plate 66 is positioned against the left-hand end of the ram block 62 and a tool holder plate 68 is against the spacer plate. Punches 72 are mounted in the tool holder plate and retained in position by suitable keys. The punches 72 extend through openings in a retainer plate 70 and in the face plate assembly 74 which is described below. The tool holder plate, the retainer plate 70, and the spacer 66 are held in assembled relationship to the ram block by fasteners as shown at 73.

The face plate assembly 74 comprises a face plate 76 and a support plate 78 which is secured to the face plate by fasteners 80 and which is also accurately positioned by dowel pins as shown. When the first tooling assembly 38 is in its open and retraced position, FIG. 4, the leading ends of the punches are recessed in the face plate 76 but they move from this plate and enter the strip when the holes are punched. The face plate assembly functions as a stripper plate when the first tooling assembly moves from its closed position to its open position and it also serves as a guide and protecting means for the ends of the punches 72. The face plate assembly must therefore be biased resiliently to the position shown in FIG. 4 but must be capable of moving relatively towards and against the tooling retainer plate 70. The face plate assembly is therefore biased to its position as shown in FIG. 4 by spring means 82 contained in a recess in the ram block. The spring means pushes a rod 84 leftwardly as viewed in FIG. 4 and against the support plate 78. A plurality of similar rods 84 and springs 82 are provided, only one such biasing means being shown in FIG. 4.

Guide plates 86 are mounted on the face plate assembly 74 and extend rightwardly over surface portions of the ram block. These guide plates 86 ensure precise movement and accurate control of the face plate assembly as described in application Ser. No. 74,656.

Figure 1:
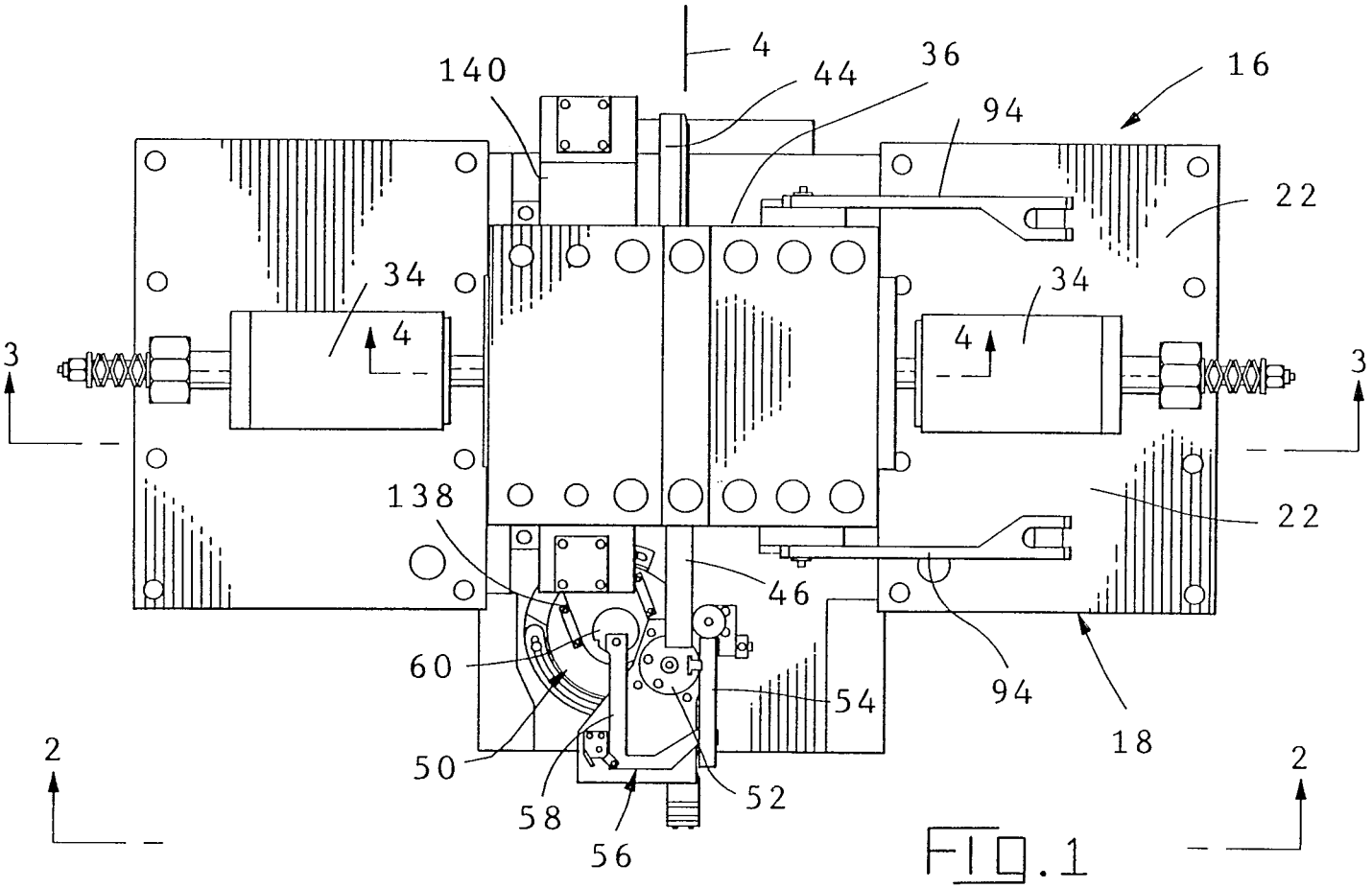
FIG. 1 is a top plan view of a machine module which incorporates the invention.

Pilot pins 88 are provided in the tooling assembly 38 and enter the pilot holes prior to punching of the holes in the strip material. These pilot pins 38 extend through aligned openings to a transverse opening 92 in the ram block 62 and are coupled to a bar 90 which extends beyond the sides of the housing 36 as shown in FIG. 1. The ends of the bar 90 are pivotally connected to connecting rods 94 which extend to levers 96, FIG. 3. The levers 96 are pivoted intermediate their ends as shown at 98 and are pivoted at their lower ends 99 to arms 100 that extend from, and are eccentrically coupled to, the shaft 20. It will be apparent from FIG. 3 that during rotation of the shaft 20, the levers 96 are oscillated, thereby driving the pilot pins into, and retracting the pins from, the strip material.

The second tooling assembly 40 comprises a die plate 102 having die openings 104 therein, which are in alignment with the punches, and a spacer plate 106 which is against the second ram block 108. Fasteners are provided as previously described to secure these parts to each other. Additionally, keys 109 (FIG. 5) are provided to secure the ram block 108 to the spacer plate 106.

Figure 5:
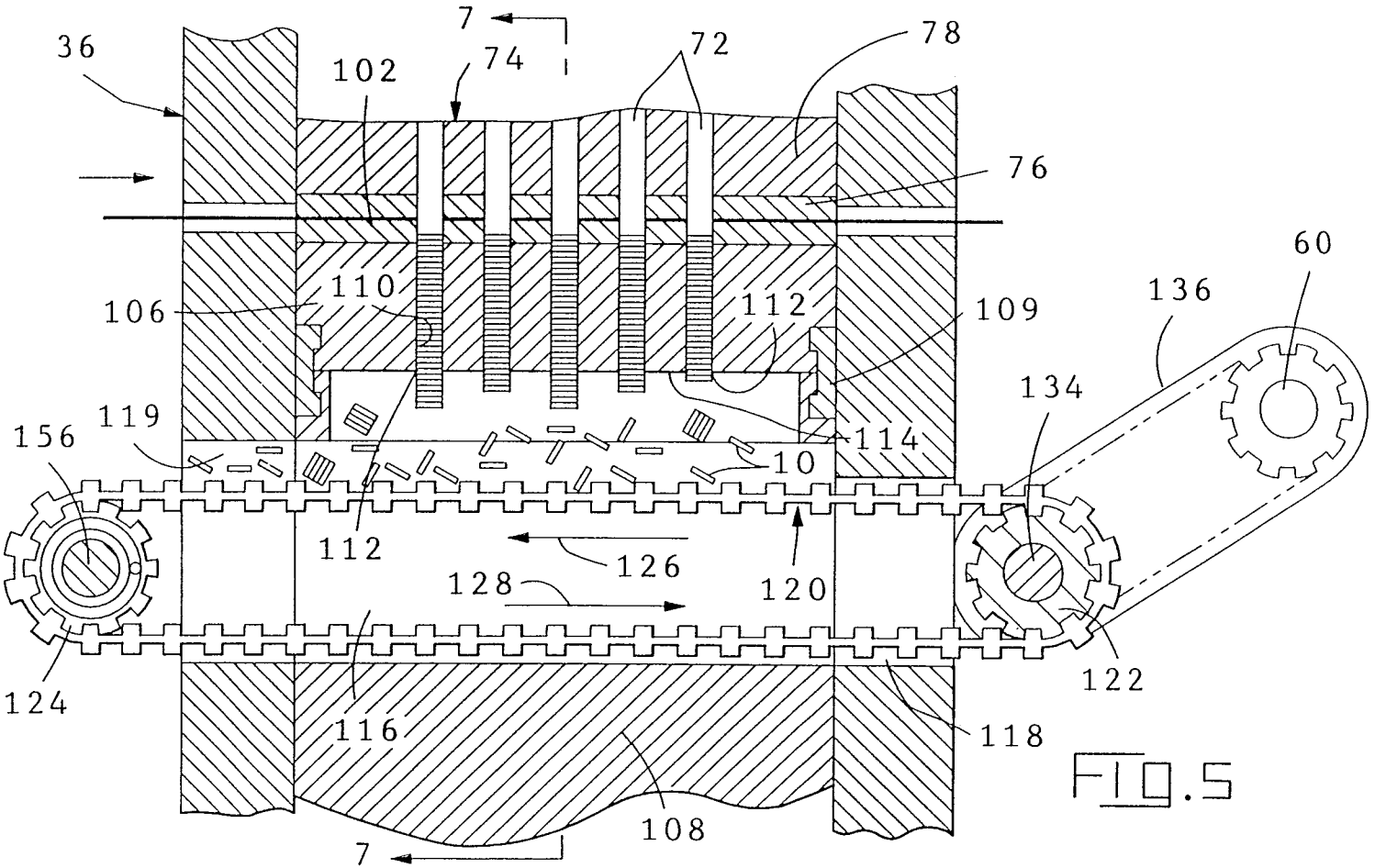
FIG. 5 is a fragmentary view looking in the direction of the arrows 5—5 of FIG. 7 showing the slug removing system, this view showing the positions of the parts when the tooling assemblies are in their closed positions and are against each other.
Figure 6:
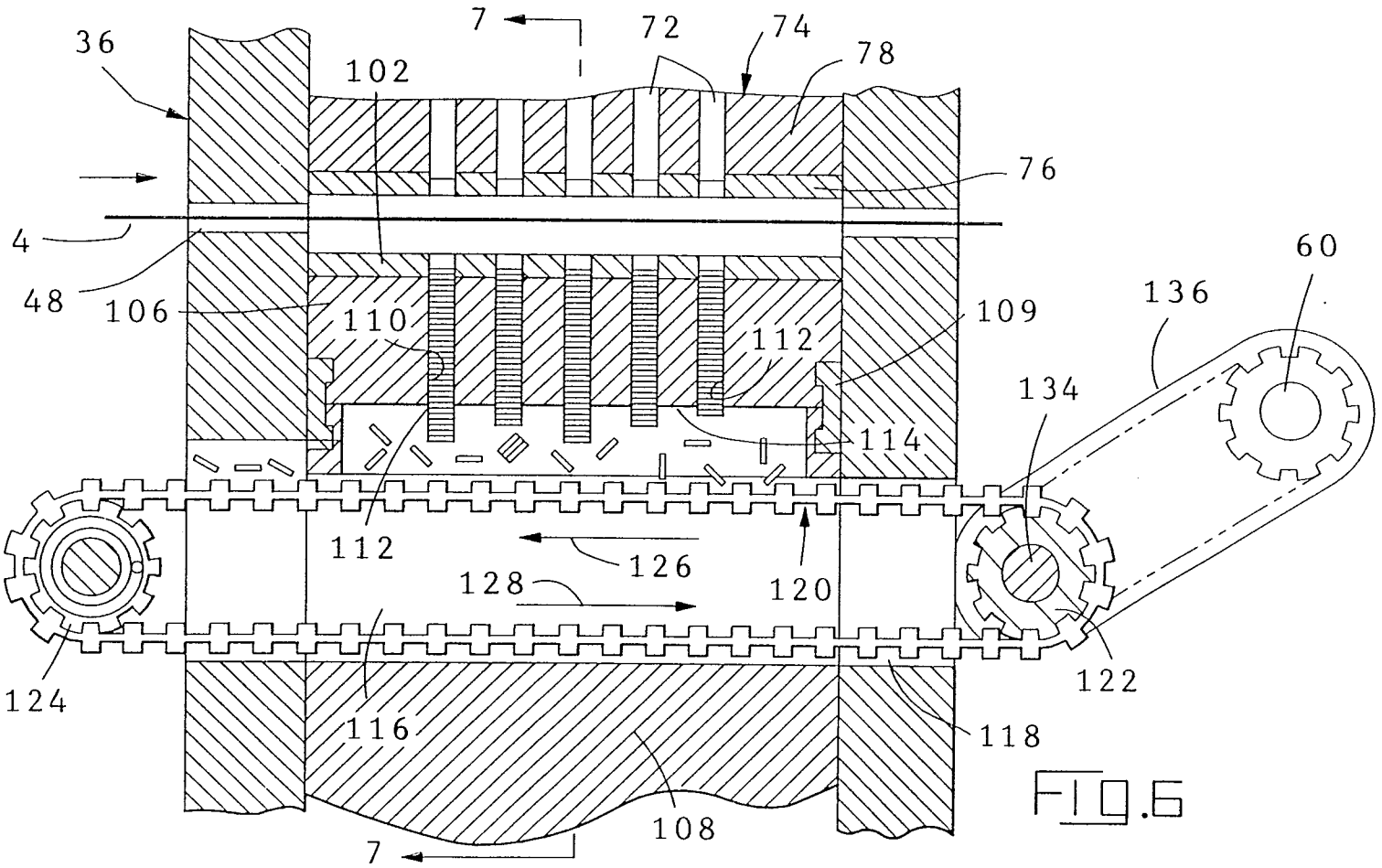
FIG. 6 is a view similar to FIG. 5 but showing the positions of the parts when the the tooling assemblies are in their open positions, that is when they are remote from each other.
Figure 7:
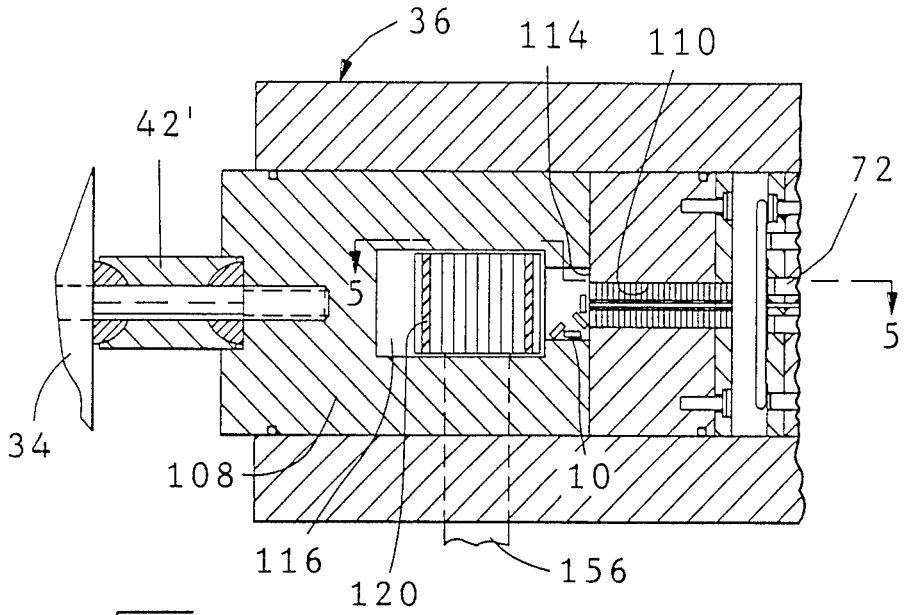
FIG. 7 is a fragmentary view on an enlarged scale looking in the direction of the arrows 7—7 of FIG. 6.

As shown in FIGS. 5–7, slug receiving passageways 110 extend from the die openings 104 through the spacer plate 106 and to a transverse belt passageway 116. Slug outlets 112 are provided at the ends of these passageways and the slugs themselves move from these outlets as shown in FIGS. 5 and 6. The passageways have cross sections or profiles which match the cross sections or profiles of the slugs 10 so that the slugs form orderly stacks in each of the passageways as shown in FIG. 5. Openings are provided in the sidewalls of the tooling assembly housing 36 as shown at 118 and 119 for a belt 120 which removes the slugs from the passageway 116. The opening 119 is somewhat wider than the opening 118 in order to facilitate removal of the slugs.

The endless belt 120 is of rubber or rubber-like material so that it is flexible and extends around driven sprocket 122 and an idler sprocket 124. The belt has a slug removing course indicated by the arrow 126 in FIG. 5 and a return course 128. The belt has teeth on its outside surface and on its inside surface, the inside teeth being cooperable with the teeth of the sprockets 122, 124. The teeth on the outside surface form pockets which are spaced apart along the length of the belt and which receive the slugs and assist in pushing them leftwardly as viewed in FIG. 5 to the outlet opening 119. Auxiliary means such as a rotating brush or the like may be provided adjacent to the idler sprocket 124 to remove the slugs from the belt but most of the slugs will fall by gravity and can be directed into a suitable receptacle.

The endless belt is continuously moved by the driven sprocket 122 which is mounted on a jack shaft 134 which is in turn coupled by a drive belt 136 to a sprocket to the previously identified continuously rotating shaft 60. Suitable housings as shown at 138, 140 (FIG. 1) are provided for the ends of the belt and for the belt 136 and the upper end of the shaft 60. The idler sprocket 124 is freely rotatable on a fixed shaft 156.

The operation of the scrap removing system will be apparent from the foregoing description. During continuous operation, the slugs are stacked in the openings 110 as shown in FIG. 5 and pushed beyond the wall 114 of the spacer 106 through the scrap removal outlets 112 and into the space between the belt and the wall 114. The wall 114 moves towards and away from the belt with movement of the second tooling assembly 40. The belt in turn pushes or drags the individual slugs leftwardly along the scrap removal course 126 and they are disposed of exteriorly of the housing wall as previously described. As shown in FIG. 5, the slugs may adhere to each other and project, cantilever position, from the slug outlets 112. This adherence is caused by the thin film of lubricant on each slug and the small size of the slugs.

The necessity for an effective scrap removal system for the machine module 16 can be appreciated from a simple calculation of the amount of scrap produced in a very brief time interval. For example, if it is assumed that the module is operating at a speed of 2,000 RPM (a common operating speed which is frequently exceeded) and if it is further assumed that the stock material has a thickness of 0.01 inches, it can be calculated that for each punch and die, a stack of slugs 20 inches long will be produced per minute. As shown in FIG. 5, the disclosed embodiment has five punches and five dies so that five such stacks of slugs are produced during every minute of operation. In other words, the combine lengths of these stacks of slugs would be over eight feet. At higher operating speeds, correspondingly more slugs would be produced during each minute of operation.

The slugs may be quite small and if they are not effectively removed, they will very soon jam the machine and quite possibly damage the tooling. It will be apparent also that the belt 120 must be moved at a relatively high speed in order effectively to do its job. It has been found that a linear belt speed of about two feet per second is required to remove the slugs from a machine operating at even a moderate speed.

It is highly desirable to provide a detecting means of some sort in the embodiment of the invention described above in order to detect failure of the scrap removal system, particularly failure as by fracture or breaking of the belt 120. When only a single belt is used as in the previously described embodiment, this can be done in a variety of ways, preferably a photoelectric cell. Under some circumstances, more than one belt may be required in the scrap removal system, and a specific detection system is provided for a scrap removal system having multiple belts as described below.

Figure 11:
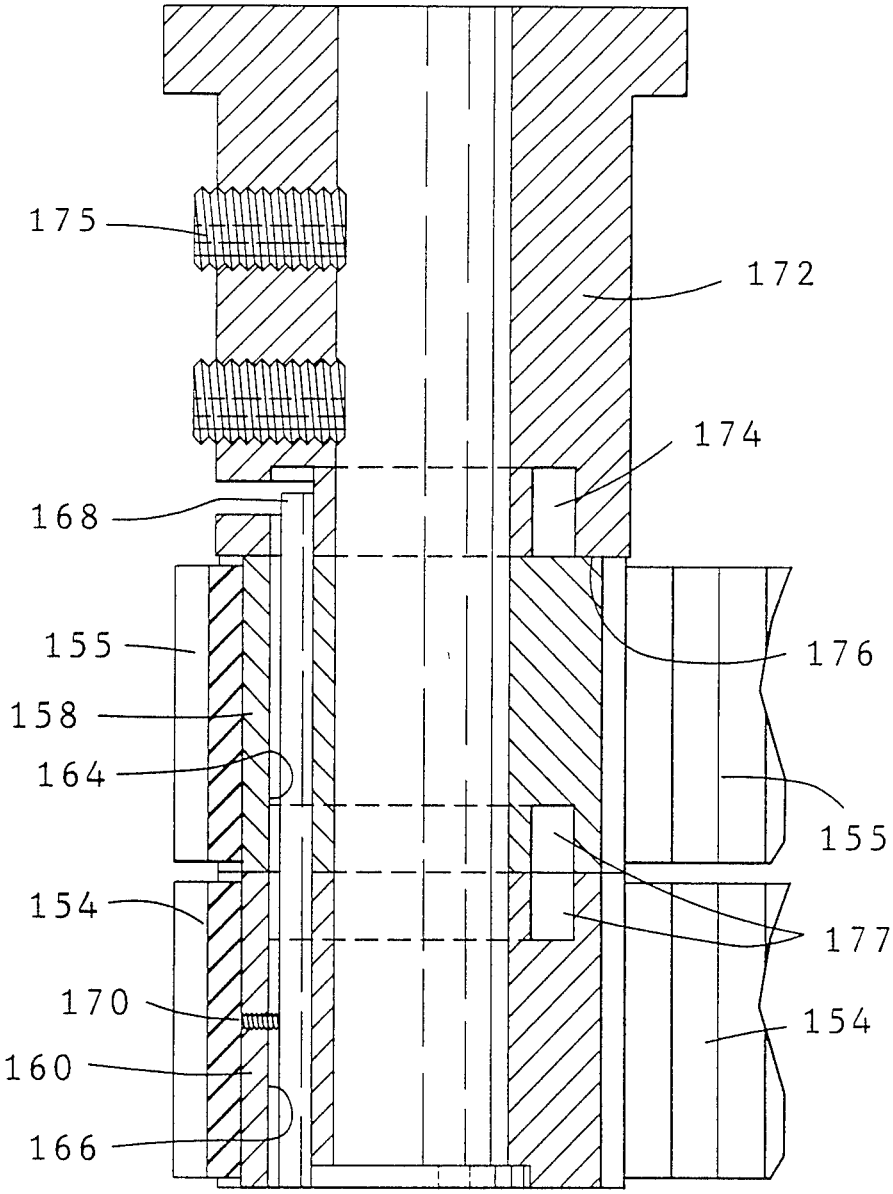
FIG. 11 is a sectional view showing a stationary shaft supporting two sprockets for two scrap removal belts, an arrangement which is used for the multiple scrap removal belts of FIG. 10.
Figure 12:
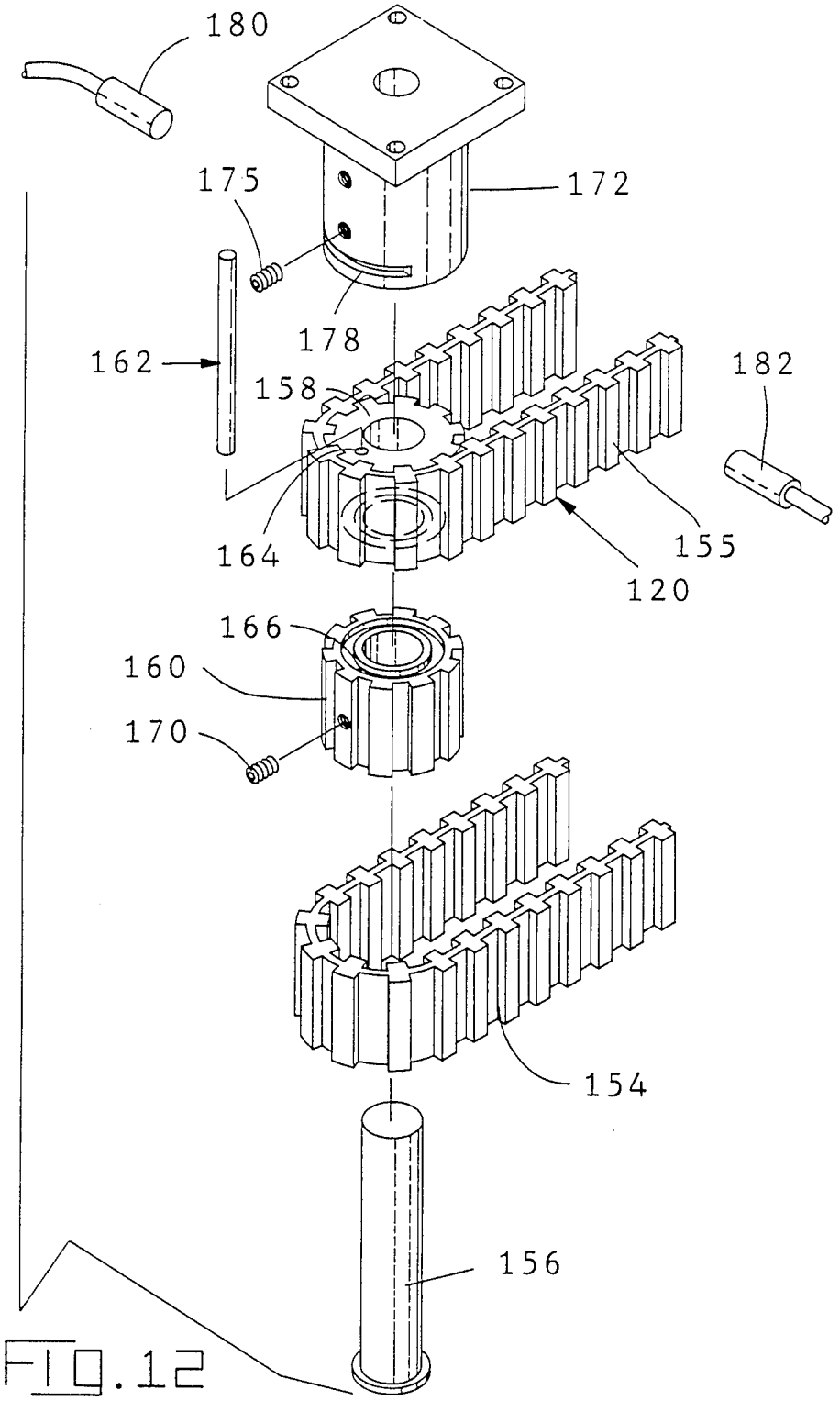
FIG. 12 is a perspective view of the belts and shaft shown in FIG. 11 with the parts exploded from each other.

Referring to FIGS. 9–12, a die plate 142 is shown which has a plurality of die openings 144, 146, 148 which are not coplanar but which are on different levels in the tooling assembly 150. In this case, a plurality of belt openings 152 are provided for a plurality of belts, two such belts being shown at 154 and 155. Each of the belts is driven by its own drive sprocket and has its own idler sprocket as previously described. All of the drive sprockets are mounted on a common drive shaft and all of the idler sprockets are mounted on a common fixed shaft (156, FIG. 11). In order to provide a single detection system for all of the belts, an arrangement as shown in FIGS. 11 and 12 is used. In FIG. 11, the idler sprockets 158, 160 are supported on the fixed shaft 156 and the belts extend around these sprockets as previously described. The sprockets are independent of each other so that if one of the belts 154 or 155 were to fail, the remaining belts would continue to move and the machine would continue to operate unless an indicator as described below is provided.

The indicator 162 is in the form of a filament of a plastic material, such as polyurethane, which is both tough and flexible. The indicator is positioned in holes 164, 166 in the upper and lower sprockets which are aligned with each other. The indicator is secured to the lower sprocket by a set screw 170. The upper portion 168 of the indicator serves as an indicated portion and extends beyond the upper sprocket and into a circular recess 174 in a fixed cap member 172 which is also secured to the stationary shaft by screws 175 as shown. So long as the two belts are moving at the same speed, the detected portion 168 of the indicator will follow a circular path in the circular recess 174 that extends inwardly from the bottom 176 of the cap member 172.

A segmental slot 178 is provided in the cap member and intersects the circular opening 174. A light source 180 and a light receiver 182 are positioned adjacent to the cap member on each side of the segmental slot 178 so that light emanating from the source at 180 and directed at the receiver 182 passes through the slot and intersects the circular opening 174. The signals produced by the source and receiver 180, 182 are transmitted to an analyzer (not specifically shown) which can be set, in the usual manner, to react in the event that a given condition changes. For example, the analyzer can be set to allow the machine to continue to operate so long as the light path is interrupted periodically by the detected portion 168 of the indicator 162.

If either of the belts 152 or 154 were to fail, the idler sprocket associated with that belt would no longer be rotated on the fixed shaft 156 although the other sprocket would continue to rotate. Under such circumstances, the indicator would be pulled downwardly, as viewed in FIG. 11, so that the detected portion 168 of the indicator would move out of the circular recess 174. Immediately, the signal analyzer associated with the light sources would detect that the light beam was no longer being periodically interrupted and would shut down the machine. Circumferential recesses 177 are provided in the sprockets 158, 160 to permit movement of the indicator in the event that one of the belts breaks. If these recesses 177 were not provided, the indicator would be sheared upon breakage of a belt.

The detection system shown in FIGS. 11 and 12 can be used with a variety of types of machine elements, for example, two machine elements which normally move in unison along rectilinear paths. A detector in accordance with the invention would immediately detect any relative movement of the two parts with respect to each other in the event that one should move relative to the other rather than remain in its normal position with respect to the other part.

It will be apparent from the foregoing that an effective and practical scrap removal system has been provided for stamping and forming machines of the type which operate at high speed and which are arranged such that the strip material is in a vertical plane when it passes through the punching stations of the machine. In addition, it will be apparent that a sensing means of general utility has been provided which is extremely useful in conjunction with the scrap removal system disclosed herein but which can be used under a variety of other circumstances.

We claim:

1. A machine for performing punching operations on strip material which is fed in a vertical plane along a strip feed path, the machine having a punching zone through which the strip feed path extends, first and second tooling assemblies in the punching zone, the tooling assemblies being opposed to each other and being on opposite sides of the strip feed path, the tooling assemblies being movable relatively towards and away from each other along a tooling path which extends normally of the strip feed path, the tooling assemblies being movable between an open position and a closed position, the tooling assemblies being remote from the strip feed path in the open position and being substantially against each other and against the strip material on the strip feed path when in the closed position, the first tooling assembly having at least one punch therein and the second tooling assembly having a die having a die opening in alignment with the punch whereby during movement from the open position to the closed position, the punch punches a hole in the strip material and the resulting scrap slug is pushed by the punch into the die opening, the machine being characterized in that:

the second tooling assembly has a slug receiving passageway extending therethrough parallel to the tooling path, the slug receiving passageway being in alignment with, and extending from, the die opening to a slug outlet, the slug receiving passageway having a profile which conforms to the profile of the die opening and to the profile of the slugs produced by the punch and die, and slug removing and transporting means are provided at the slug outlet, the slug removing and transporting means being movable along a slug transporting path which extends transversely of the tooling path and past the slug outlet to a location beyond the second tooling assembly, whereby, during continuous operation of the machine, the slugs produced by the punch and die are pushed by the punch through the die opening and into the slug receiving passageway and form a stack of aligned slugs in the passageway, and slugs which are pushed from the passageway at the slug outlet are removed and transported laterally to a location beyond the second tooling assembly.

2. A machine as set forth in claim 1 characterized in that each of the first and second tooling assemblies is movable along the tooling path when the tooling assemblies move between the open and closed positions, the slug transporting path being a straight line path, the slug removing and transporting means comprising a flexible member which is flexible laterally of the slug transporting path.

3. A machine as set forth in claim 2 characterized in that the slug removing and transporting means comprises an endless flexible belt.

4. A machine as set forth in claim 3 characterized in that the second tooling assembly has a belt passageway extending therethrough, the slug outlet communicating with the belt passageway, the belt being in the belt passageway.

5. A machine as set forth in claim 4 characterized in that the belt passageway has a width, as measured parallel to the tooling path and normally of the slug transporting path, which is sufficient to accommodate the belt and to permit movement of the second tooling assembly between its open and closed positions.

6. A machine as set forth in claim 5 characterized in that the endless flexible belt has a slug removing course and a return course, the slug removing course extending adjacent to, and past, the slug outlet, the return course being spaced from the slug outlet, the second tooling assembly being adjacent to the slug removing course when it is in its open position.

7. A machine as set forth in claim 6 characterized in that the belt has an outside surface and an inside surface, the outside surface being movable past the slug outlet on the slug removing course, the inside surface being opposed to itself in the slug removing course and the return course, the outside surface having spaced-apart slug receiving pockets therein for receiving slugs at the slug outlet.

8. A machine as set forth in claim 7 characterized in that the inside surface has sprocket teeth thereon, the inside surface extending around and being against sprocket wheels which are located on each side of the tooling path.

9. A machine as set forth in claim 2 characterized in that the endless flexible belt has a slug removing course and a return course, the slug removing course extending adjacent to, and past, the slug outlet, the return course being spaced from the slug outlet, the second tooling assembly being adjacent to the slug removing course when it is in its open position.

10. A machine as set forth in claim 8 characterized in that a plurality of punches and die openings are provided, each of the die openings having a slug receiving passageway and a slug outlet in alignment therewith the punches, the die openings, the slug receiving passageways, and the slug outlets being in coplanar relationship with each other.

11. A machine for performing punching operations on strip material which is fed in a vertical plane along a strip feed path, the machine having a punching zone through which the strip feed path extends, first and second tooling assemblies in the punching zone, the tooling assemblies being opposed to each other and being on opposite sides of the strip feed path, the tooling assemblies being movable towards and away from each other along a tooling path which extends normally of the strip feed path, the tooling assemblies being movable between an open position and a closed position, the tooling assemblies being remote from the strip feed path in the open position and being substantially against each other and against the strip material on the strip feed path when they are in the closed position, the first tooling assembly having at least two punches therein and the second tooling assembly having a die having at least two die openings in alignment with the punches whereby during movement from the open position to the closed position, the punches punch holes in the strip material and the resulting scrap slugs are pushed by the punches into the die openings, the machine being characterized in that:

the second tooling assembly has at least two slug receiving passageways extending therethrough parallel to the tooling path, the slug receiving passageways being in alignment with, and extending from, the die openings to the slug outlets, the slug receiving passageways having profiles which conform to the profiles of the die openings and to the profiles of the slugs produced by the punches and dies, and at least two slug removing and transporting means are provided at the slug outlets, each slug removing and transporting means being movable along its own slug transporting path, the slug transporting paths being side-by-side, parallel to each other, and extending transversely of the tooling path to locations beyond the second tooling assembly, whereby, during continuous operation of the machine, the slugs produced by the punches and dies are pushed by the punches through the die openings and into the slug receiving passageways and form stacks of aligned slugs in each of the passageways, and slugs which are pushed from the passageways at the slug outlets are removed and transported laterally to locations beyond the second tooling assembly.

12. A machine as set forth in claim 11 characterized in that each of the slug removing and transferring means comprises an endless belt, each of the belts extending around a driven wheel means and an idler wheel means, the driven wheel means and the idler wheel means being on common shafts whereby the belts are driven at the same speed.

13. A machine as set forth n claim 12 characterized in that sensing means is provided for sensing movement of either of the idler wheel means relative to the other idler wheel means whereby failure of either of the belts will be detected.

14. A machine as set forth in claim 13 characterized in that the sensing means comprises an indicator and a detector, the indicator comprising an elongated flexible member having a first portion, a second portion, and a detected portion, the first portion being in one of the idler wheel means, the second portion being in the other idler wheel means, the detected portion being located beyond the idler wheel means in a predetermined position whereby upon relative movement of one of the idler wheel means with respect to the other idler wheel means, the detected portion will be moved from its predetermined position, the detector being located proximate to the predetermined position and being effective to detect movement of the detected portion.

15. Sensing means for sensing relative movement of a first element, such as an element of a machine, with respect to a second element, the two elements being normally in fixed predetermined positions with respect to each other and being movable in unison without change in their fixed positions with respect to each other, the sensing means comprising:

an indicator and a detector, the indicator comprising an elongated flexible member having a first portion, a second portion, and a detected portion, the first and second portions being in the first and second elements respectively, the detected portion being located externally of the first and second elements, the indicator being movable in the direction of its length with respect to the first and second elements, the detector comprising detection means which is in observing relationship to the detected portion of the indicator and which detects movement of the detected portion of the indicator in the direction of the length of the indicator, whereby, in the event of relative movement of the first element with respect to the second element during movement of the first and second elements in unison, the detector will detect the resulting movement of the detected portion of the indicator and thereby detect the relative movement of the first element with respect to the second element.

16. Sensing means as set forth in claim 15 characterized in that the first and second elements have aligned openings extending therethrough normally of the direction of movement in unison of the first and second elements, the detector being in the aligned openings.

17. Sensing means as set forth in claim 16 characterized in that the first and second elements are rotating elements having an axis of rotation, the aligned openings and the detector extending parallel to the axis of rotation.

18. Sensing means as set forth in claim 17 characterized in that the detected portion is located beside one of the elements and projects beyond the one element whereby the detected portion moves into the opening in the one element in the event of relative movement of one of the elements with respect to the other element.

19. Sensing means as set forth in claim 18 characterized in that the detector is a photoelectric detector.

20. Sensing means as set forth in claim 15 characterized in that one of the first and second portions is secured to its associated element.

* * * * *